US010455333B2

(12) United States Patent
Dickmann et al.

(10) Patent No.: US 10,455,333 B2
(45) Date of Patent: Oct. 22, 2019

(54) WIRELESS BODY WORN PERSONAL DEVICE WITH LOSS DETECTION FUNCTIONALITY

(71) Applicant: Sonova AG, Staefa (CH)

(72) Inventors: Georg Dickmann, Ebmatingen (CH); Daniel Lucas-Hirtz, Rapperswil (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/083,896

(22) PCT Filed: Mar. 14, 2016

(86) PCT No.: PCT/EP2016/055405
§ 371 (c)(1),
(2) Date: Sep. 11, 2018

(87) PCT Pub. No.: WO2017/157409
PCT Pub. Date: Sep. 21, 2017

(65) Prior Publication Data
US 2019/0082274 A1 Mar. 14, 2019

(51) Int. Cl.
*H04R 25/00* (2006.01)
*H04R 1/10* (2006.01)

(52) U.S. Cl.
CPC ..... *H04R 25/407* (2013.01); *H04R 1/1041* (2013.01); *H04R 25/305* (2013.01);
(Continued)

(58) Field of Classification Search
CPC .. H04R 1/1041; H04R 25/305; H04R 25/554; H04R 25/407; H04R 25/453;
(Continued)

(56) References Cited

U.S. PATENT DOCUMENTS 8,005,248 B1 * 8/2011 Davant ..... H04R 25/305 381/324
2013/0343584 A1 12/2013 Bennett et al.
(Continued)

FOREIGN PATENT DOCUMENTS

EP 2908550 A1 8/2015

OTHER PUBLICATIONS

International Search Report and Written Opinion of PCT/EP2016/055405; Applicant: Sonova AG; dated Jul. 13, 2016; 13 pages.

*Primary Examiner* — Melur Ramakrishnaiah

(57) ABSTRACT

There is provided a personal device to be worn at the body of a user (15), comprising an interface (20) for wireless data exchange with an external device (11, 39, 50); at least one sensor (28, 42, 44, 46) for sensing a parameter indicative of the proximity of the personal device (10) to the user; a loss detection unit (40) for determining, by regularly analyzing signals received from the sensor, whether the personal device is presently worn by the user or not; a control unit (38) for controlling operation of the personal device in a regular mode as long as the loss detection unit determines that the personal device is worn by the user and in a loss mode as long as the loss detection unit determines that the personal device is no longer worn by the user, wherein the wireless interface is directed to transmit in the regular mode a non-traceable device address and to transmit in the loss mode a traceable public device address.

19 Claims, 3 Drawing Sheets

(52) U.S. Cl.
CPC ..... *H04R 25/453* (2013.01); *H04R 25/554* (2013.01); *H04R 25/552* (2013.01); *H04R 25/558* (2013.01); *H04R 2225/41* (2013.01); *H04R 2225/55* (2013.01); *H04R 2225/61* (2013.01); *H04R 2460/03* (2013.01)

(58) Field of Classification Search
CPC ..... H04R 25/552; H04R 25/558; H04R 2225/41; H04R 2225/61; H04R 2460/03; H04R 2225/55
USPC ..... 381/330, 322, 323, 324, 325, 326, 381/315–317, 328; 704/233
See application file for complete search history.

(56) References Cited

U.S. PATENT DOCUMENTS

| | | | | |
|---|---|---|---|---|
| 2015/0172835 | A1* | 6/2015 | Sacha ..... | H04R 25/558<br>381/315 |
| 2015/0230036 | A1* | 8/2015 | Pedersen ..... | H04R 1/1041<br>381/330 |
| 2016/0007181 | A1 | 1/2016 | Palin et al. | |

* cited by examiner

WIRELESS BODY WORN PERSONAL DEVICE WITH LOSS DETECTION FUNCTIONALITY

The invention relates to a personal device such as a hearing assistance device, to be worn at the body of a user and comprising an interface for wireless data exchange with external devices, such as a Bluetooth ("BT") interface.

In general, wireless devices which have been lost by the user may be found and identified by reception of signals transmitted from the wireless interface of the device, such as advertisements and/or scanning responses. The detection of a lost personal device is particularly easy in case that the personal device uses a wireless communication protocol with propagation of public addresses, since in this case the personal device is traceable due to the propagation of address information contained in the wireless frames by any other device using the same wireless communication protocol. However, for privacy reasons, it may be preferable to use a communication protocol which suppresses traceability by using addresses which are only resolvable to devices that have previously been authenticated, such as by a pairing/bonding procedure. An example of such communication protocols supporting privacy-protection is BT Smart. However, when a personal device using a privacy-protecting protocol is lost, only devices which have previously been paired/bonded with the lost personal device can be helpful in the search for the lost device.

It is known for binaural hearing aid systems to monitor mutual connectivity and to provide for an acoustic alarm to the user of the system once the wireless link between the right ear hearing aid and the left ear hearing aid is found to be broken.

EP 2 908 550 A1 relates to a hearing aid comprising a wireless interface and one or more sensors for detecting loss of the hearing aid, such as an accelerometer for detecting a freefall of the hearing aid; other sensors may a temperature sensor, a heart pulse sensor, an own voice detector, an acoustic feedback detector and/or a detector for the wireless range between the hearing aid and a hearing aid worn at the other ear. Once loss of the hearing aid has been detected by the sensor(s), various actions may be taken: a signal is sent to an external device in order to alert the user of the hearing aid and to provide information as to where and when the hearing aid was lost (for example, the external device may be a smartphone which logs the position where the hearing aid was lost and displays an alarm signal); the hearing aid may automatically turn off power or is put into a low power sleep mode with minimized power consumption; and/or a localization signal may be transmitted at maximum transmission power.

It is an object of the invention to provide for a body-worn personal device having a wireless interface, wherein privacy of the user of the personal device is protected while the personal device nevertheless can be easily detected when lost. It is a further object to provide for a corresponding method for searching for such personal device when lost.

According to the invention, these objects are achieved by a personal device as defined in claim 1 and a method as defined in claim 30, respectively.

The invention is beneficial in that, by detecting loss of the personal device by regularly analyzing sensor signals concerning a parameter indicative of the proximity of the device to the user and by switching the wireless interface from transmitting a non-traceable device address in a regular mode in which the device is worn by the user to transmitting a traceable public device address in a loss mode once loss of the device has been detected, privacy of the user is protected during normal use of the personal device, while the device can be found relatively easily when lost, since the signals using a traceable public device address can be received not only by devices previously having been paired/bonded with the personal device but also by any other device capable of using the respective wireless communication protocol.

Preferably, the wireless interface is a BT smart interface, wherein the non-traceable device address is a random resolvable BT address and the public device address is a public BT address.

Preferably, the personal device is a hearing assistance device to be worn at ear level, such as a hearing aid.

Preferred embodiments of the invention are defined in the dependent claims.

Hereinafter, examples of the invention will be illustrated by reference to the attached drawings, wherein.

The present invention relates to personal devices to be worn at the body of a user, in particular hearing assistance devices, such as hearing aids, headphones, and earbuds, which are designed such that they can be easily found by receiving signals from the wireless interface of such personal device, while privacy of the user is protected during normal use of the devices, i.e. as long as the devices are not lost.

Figure 1:
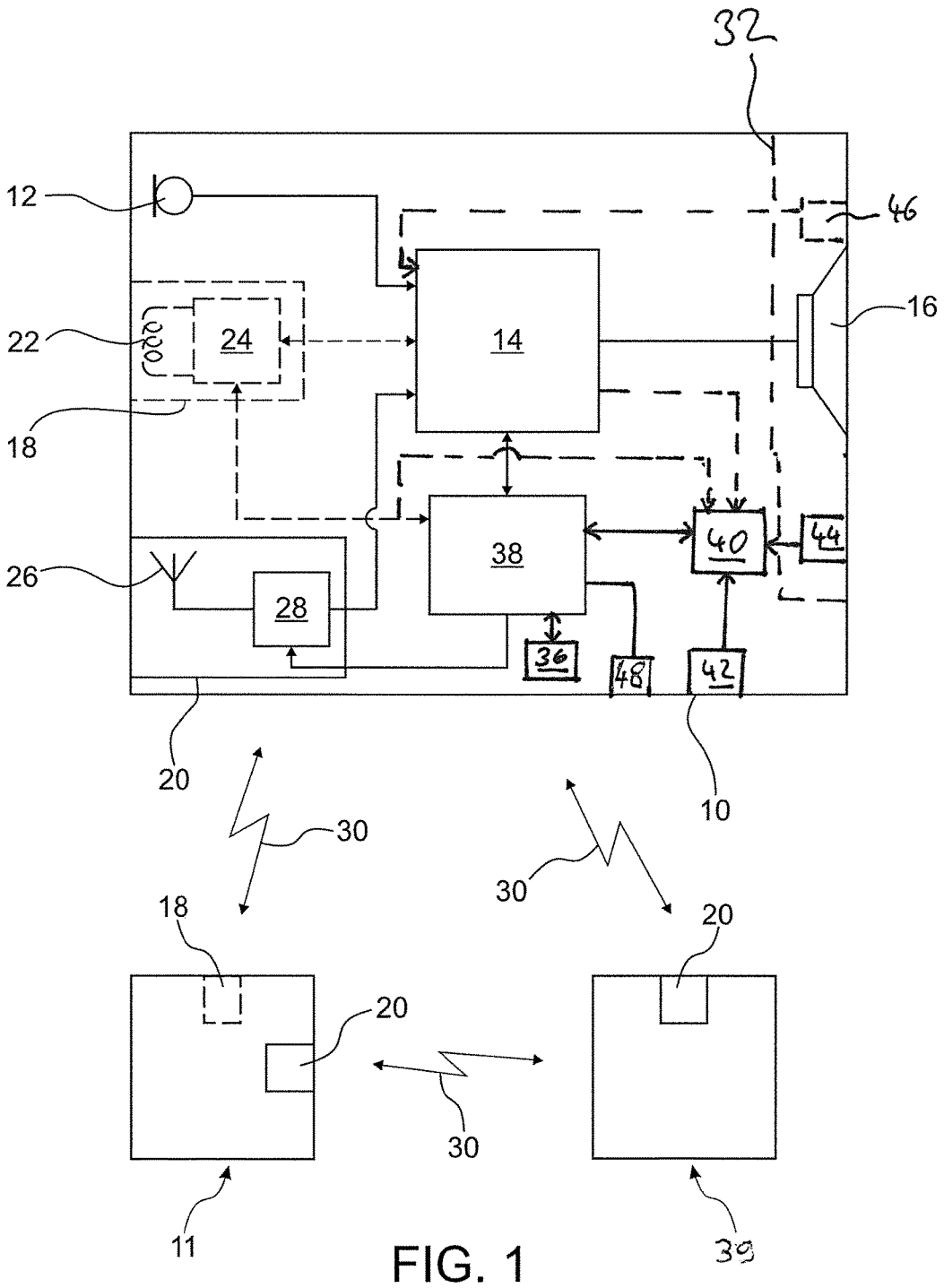
FIG. 1 is a schematic block diagram of an example of a personal device according to the invention when used together with other wireless devices.

FIG. 1 is a block diagram of an example of a system comprising a first hearing assistance device 10 to be worn at one ear of a user, a second hearing assistance device 11 to be worn at the other ear of the user and at least one external device 39. The first and second hearing assistance devices 10, 11 typically are ear level devices and preferably form a binaural hearing system. Preferably, the hearing devices 10, 11 are hearing instruments, such as BTE (behind-the-ear), ITE (in-the-ear) or CIC (completely-in-the-channel) hearing aids. However, the hearing devices, for example, also could be an auditory prosthesis, such as a cochlear implant device comprising an externally worn sound processor which can be lost.

In the example of FIG. 1, the hearing assistance devices 10, 11 are hearing aids comprising a microphone arrangement 12 for capturing audio signals from ambient sound, an audio signal processing unit 14 for processing the captured audio signals and an electro-acoustic output transducer (loudspeaker) 16 for stimulation the user's hearing according to the processed audio signals (these elements are shown in FIG. 1 only for the hearing aid 10).

The hearing aids 10, 11 comprise a wireless interface 20 comprising an antenna 26 and a transceiver 28.

The interface 20 is provided for enabling wireless data exchange between the first hearing aid 10 and the second hearing aid 11 via a wireless link 30 which serves to realize a binaural hearing assistance system, allowing the hearing aids 10, 11 to exchange audio signals and/or control data and status data, such as the present settings of the hearing aids 10, 11.

The interface 20 is also provided for data exchange via a wireless link 30 from an external device 40, for example for receiving an audio data stream from an external device 40 acting as an audio source, comprising a wireless interface 20.

For example, the interface 20 may be adapted to operate in a frequency range of 0.38 GHz to 5.825 GHz, preferably at frequencies around 2.4 GHz in the ISM band. Typically, the interface 20 is a Bluetooth Smart interface; alternatively, it may use another standard protocol which allows for the alternating use of non-traceable device addresses (i.e. addresses which change with time) and public device addresses (i.e. addresses which are constant in time).

The hearing aids 10, 11 also comprise a controller 38 for controlling operation of the hearing aids 10, 11, with the controller 38 acting on the signal processing unit 14 and the transceiver 28, and a memory 36 for storing data required for operation of the hearing aid 10, 11 and data required for operation of the interface 20, such as pairing/network data.

While the binaural link between the hearing devices 10, 11 may be realized by the wireless interfaces 20 which are also used for the connection with the external devices, the binaural link alternatively could be realized by a separate interface using a different technology, such as an inductive link or a proprietary protocol. An example is shown in dashed lines in FIG. 1, according to which the hearing aids 10, 11 in addition to the interface 20 comprise a second interface 18, including an antenna 22 and a transceiver 24, which is used for realizing the wireless data exchange between the first hearing aid 10 and the second hearing aid 11 via the wireless link 30—rather than using the interface 20 to this end. For example, the second interface 18 may be designed to form part of a hearing instrument body area network (HIBAN) using an inductive link which may operate, for example, in a frequency range of 6.765 MHz to 13.567 MHz, such as at 10.6 MHz. However, rather than being implemented as an inductive link, the binaural wireless link 30 may be a far-field link requiring, such as a proprietary or standard digitally modulated link operating in the 2.4 GHz ISM band.

The hearing device 10 further comprises at least one sensor for sensing a parameter indicative of the proximity (or distance) of the device 10 to the user and a loss detection unit 40 for determining, by regularly analyzing signals received from such sensor (s), whether the hearing device 10 is presently worn by the user or not. The loss detection unit 40 provides a corresponding input to the controller 38 which thereby is enabled to control operation of the hearing device 10 in a regular mode as long as the lost detection unit 40 determines that the hearing device 10 is worn by the user and in a loss mode as long as the lost detection unit 40 determines that the hearing device 10 is no longer worn by the user (i.e. that it has been lost by the user). The main difference between the regular mode and the loss mode is that the controller 38 directs the wireless interface 20 to transmit in the regular mode a non-traceable device address (which changes with time) and to transmit in the loss mode a traceable public device address (which is constant in time).

As already mentioned above, the interface 20 preferably is a BT Smart interface, wherein in the regular mode a Random Resolvable BT address is used so that the hearing device 10 is traceable only for devices which are paired/bonded to the hearing device 10, and in the loss mode a public BT address is used so that the hearing device 10, when having been lost, may be traced by any device having a wireless interface using the same protocol, namely BT smart.

According to the example shown in FIG. 1, the hearing device 20 may comprise a first loss detection sensor 42 and a second loss detection sensor 44, which may comprise, for example, an accelerometer, a temperature sensor or a humidity sensor.

An accelerometer may be used for sensing movement of the hearing device 10, and the loss detection unit may decide, for example, that the device 10 is no longer worn by the user if the sensed acceleration is below a given threshold value for at least a given time interval (for example, if the hearing device 10 has fallen to the ground, it will no longer move).

A temperature sensor is particularly useful if placed in close proximity to the body;

preferably, a temperature sensor 44 may form part of an earpiece (indicated at 32 in FIG. 1) so as to be situated in the ear channel of the user. For example, the temperature sensor may be integrated within the loudspeaker/receiver 16 of the hearing device 10 (in case that the hearing device 10 is of the ITE or RIC type). The loss detection unit 40 may decide that the device 10 is no longer worn by the user if the sensed temperature is outside a given temperature range around the typical body temperature of 37° C.

Also in case that the sensor is a humidity sensor, it should be placed in close proximity to the body; in particular it may be placed in the ear channel as part of an earpiece 32. The loss detection unit 40 may decide that the device 10 is no longer worn by the user if the sensed humidity is below a given threshold (humidity is high in the ear channel).

According to another example, the loss sensors may comprise an acoustic feedback sensor in order to measure an acoustic feedback path of the hearing device 10; for example, such feedback sensor may comprise an (auxiliary) microphone 46 located in the ear channel (typically as part of an earpiece 32, such as in case of a RIC type hearing device). The feedback detection may be realized as part of the audio signal processing unit 14 which receives the signal of the auxiliary microphone 46; the audio signal processing unit 14 may supply a corresponding output to the loss detection unit 40 indicative of the detected feedback. The loss detection unit 40 may decide that the device 10 is no longer worn by the user if the sensed feedback is below a given threshold value, or, more generally, if the audio signals deviate sufficiently from a feedback pattern known for worn devices (acoustic feedback typically is not scalar value), i.e. that no feedback is present.

According to another example, the loss sensors may comprise an electromagnetic signal strength sensor, wherein the loss detection unit 40 may decide that the device 10 is no longer worn by the user if the strength of a signal received from another wireless device worn by the user is below a given threshold. For example, such other wireless device may be the other hearing device 11 of a binaural system, i.e. the hearing device worn at the other ear of the user. According to another example, the wireless device to be worn by the user may be an accessory device of the hearing device 10, such as a wireless microphone, a remote control and/or a streaming device, or it may be a personal communication device of the user, such as a smartphone (for example, the external device 39 shown in FIG. 1 may be such accessory device or personal communication device). Loss of contact with such other wireless device usually worn by the user indicates that the hearing device 10 has been lost. The received signal strength may be detected by the wireless interface 20 itself.

Preferably, the loss detection unit 40 uses a plurality of the above described sensor options in order to achieve high reliability of a judgement that the device has been lost.

In addition to the above mentioned switching from a non-traceable device address to a traceable (public) device address in the loss mode, the following additional actions may be taken in the loss mode.

According to one example, in the loss mode additional device identification information (i.e. information in addition to the device address) may be transmitted by the interface 20, which additional information is not transmitted in the regular mode. Such additional identification information may be dynamically added to advertisements and/or scan responses transmitted by the interface 20. The additional identification information may include the name of the device 10, an identifier for identifying the type of the device 10, personal information concerning the owner of the device, such as name, address and telephone number, and information concerning the transmission power at which the advertisements and the scan responses are transmitted by the interface 20; such transmission power information may be used by the wireless device which "finds" the lost device 10 for estimating the distance to the lost device.

Further, the transmission power of the advertisement and/or scan responses transmitted by the interface 20 may be increased in the loss mode relative to the regular mode in order to enhance the chance that such signal is received by a searching wireless device.

According to another example, the controller 38 may control operation of the device 10 in the loss mode in a manner so as to reduce power consumption compared to the regular mode. For example, the controller 38 may reduce the rate at which advertisements are transmitted by the interface 20.

According to another example, the functionality of the hearing device 10 may be generally reduced in the loss mode compared to the regular mode, such as by disabling the speaker 16, the microphone arrangement 12, the processing of the captured audio signals in the audio signal processing unit 14, and wireless connectivity functions of the personal device not forming part of the transmission of identification signals to be transmitted in the loss mode (for example, the induction interface 18 may be disabled in the loss mode).

According to another option, connectivity by other wireless devices to the hearing device 10 may be simplified in the loss mode, so that, for example, unpaired external wireless devices may be allowed to access services of the hearing device 10 in order to make the search for the device 10 more efficient. For example, unpaired devices may be allowed to connect to the hearing device 10 and to read out identification information, e.g. from the memory 36.

According to another example, unpaired devices may be allowed to connect to the device 10 and to play audio signals via the speaker 16 of the hearing device 10, such as a sound assisting a searcher to locate the lost device 10. Alternatively or in addition, such unpaired devices may be allowed to direct the hearing device 10 to emit a visual signal via a light emitter, such as a LED, of the hearing device 10 (such light emitter is schematically indicated at 48 in FIG. 1); such visual signal may assist the searcher in locating the hearing device 10.

Figure 2:
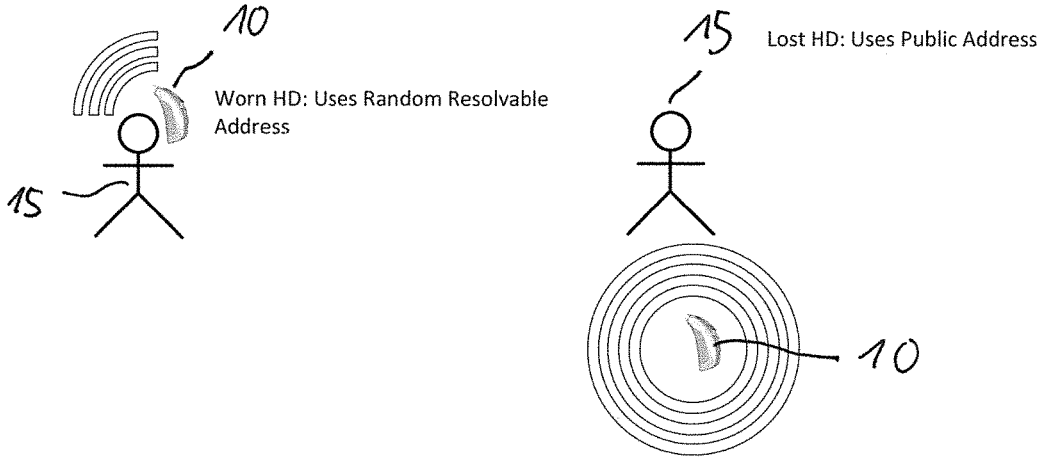
FIG. 2 is a schematic illustration of an example of a personal device when worn by a user and when having been lost by the user, respectively.

FIG. 2 is a schematic illustration of the use of the hearing device 10 in the regular mode (left hand side of FIG. 2) and in the loss mode (right hand side in FIG. 2), respectively.

Hereinafter it will be described in more detail what may happen once a lost hearing device has been found and how the lost hearing device 10 may be found.

According to one example, an application program may be provided by the manufacturer of the hearing device 10 which may be run on mobile devices, like smartphones or tablet computers, in order to assist such device in searching for a lost hearing device 10. Of course, the mobile device used in the search for a lost hearing device 10 needs to have the appropriate wireless connectivity, i.e. it needs a wireless interface capable of using the communication protocol used by the interface 20 of the hearing device 10.

For example, the application program may enable the search device to list all hearing devices within range of the interface of the search device and in the loss mode. Preferably, such listing of the lost devices within range includes listing of an estimated distance to these devices based on a measurement of the received signal strength by the search device, taking into account the transmission power level as provided by the lost device. Further, the application program may enable the search device to remotely direct the lost hearing device 10 to play audio signals via the speaker 16 and/or to emit a visual signal via the light emitter 48.

Figure 3:
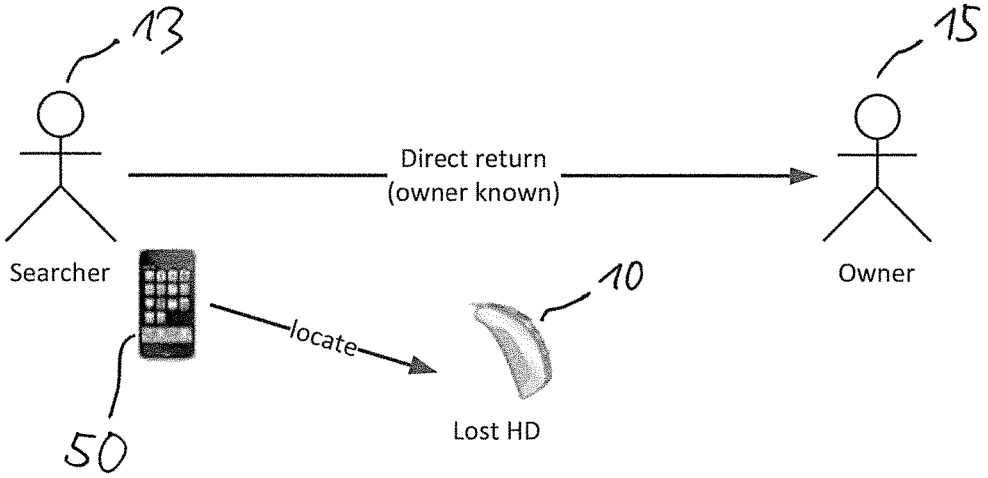
FIG. 3 is a schematic illustration of an example of the interaction between a searcher of a lost personal device and the owner of the lost personal device.
Figure 5:
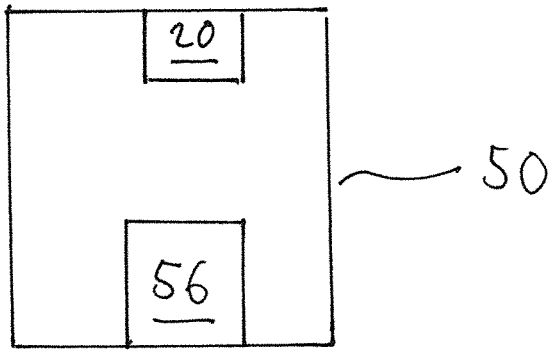
FIG. 5 is a schematic block diagram of a device for searching a lost personal device.

The easiest way of how a found hearing device could be returned to the owner 15 is schematically illustrated in FIG. 3. This case requires that the owner of the lost hearing device is personally known to the searcher 13 who has found the hearing device by using a search device 50, such as a smartphone, including a suitable wireless interface 20 and a display 56 (see FIG. 5). In this case, the searcher/finder may directly return the found device 10 to the owner.

However, usually the searcher/finder 13 of the lost device 10 will not personally know the owner 15 of the device 10. Thus it may be helpful to provide an infrastructure enabling a return service by a return service provider. Such infrastructure may include a database 52 (e.g. implemented in a cloud structure) which is used for registering a hearing device 10 with a return service provider 54, for example via a personal communication device 39 of the owner of the device 10, with the device information being provided from the personal communication device 39 to the service provider 54 who enters it into the database 52. The searcher/finder 13 who has found the lost device 10 by using a search device 50 on which a corresponding search program application of the hearing device manufacturer or return service provider 54 is run may locate the identity of the lost hearing device 10 with the help of the search device 50 by reading respective identification information provided by lost device 10. The finder 13 then may report the respective lost hearing device 10 as having been found to the service provider 54 who may then check whether the found device 10 is registered in the database 52 and, if so, may organize the logistics necessary for returning the found hearing device 10 to the owner. Alternatively, the finder 13 of the device 10 may first access the database 52 via the search device 50 in order to check whether the found device 10 is registered in the database 52 and, if so, he may contact the respective return service provider 54.

Figure 4:
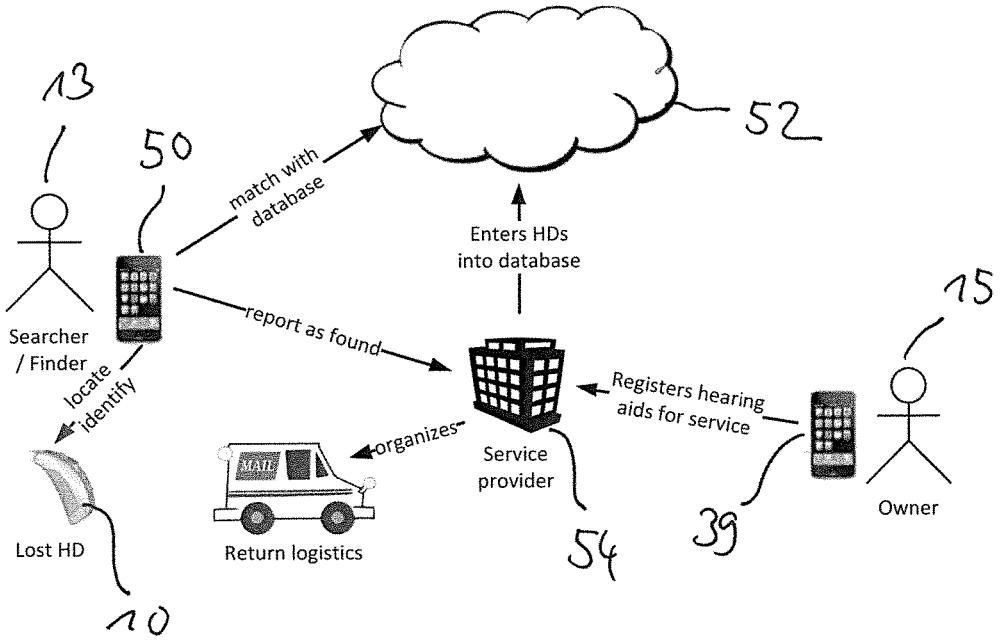
FIG. 4 is a schematic illustration of a more complex return process of a lost personal device, involving a return service provider.

An example of such infrastructure is schematically illustrated in FIG. 4.

The return service provider 54 may provide the suitable application programs for the owner 15 of the hearing device 10 to register the hearing device for the return service (such application program may be run on the personal communication device 39) and the respective application program for the search device 50 to identify the lost device 10 and to report it to the service provider 54 and/or the database 52.

Typically, the infrastructure for the return process is accessible through a public network, like the internet. According to one example, the return process may allow the owner and/or the finder of the lost hearing device 10 to remain anonymous to each other by direct communication to the return service provider 54 only. According to another example, the return process may allow the finder to remain anonymous towards the return service provider 54 by providing for a lost device collection scheme wherein the finder 13 does not need to reveal his/her identity. For example, such service may be provided by a every post office collecting lost hearing devices.

The invention claimed is:

1. A hearing device, the hearing device comprising:

an interface for wireless data exchange with an external device;

a sensor for sensing a parameter indicative of a proximity of the hearing device to a user;

a loss detection unit for determining, by analyzing signals received from the sensor, whether the hearing device is presently worn by the user;

a control unit for switching operation of the hearing device from a worn mode when the loss detection unit determines that the hearing device is worn by the user and to a loss mode when the loss detection unit determines that the hearing device is no longer worn by the user, wherein the wireless interface is configured to transmit, to an external device, in the worn mode a non-traceable device address that is resolvable to devices that have previously been authenticated by the hearing device and to transmit, to the external device, in the loss mode a traceable public device address that is traceable due to the propagation of public address information contained in the wireless frames of wireless communication protocol by any other device using the same wireless communication protocol.

2. The hearing device of claim 1, wherein the wireless interface is a BLUETOOTH interface, and wherein the non-traceable device address is a Random Resolvable BLUETOOTH address and the public device address is a Public BLUETOOTH address.

3. The hearing device of claim 1, wherein the hearing device is a hearing assistance device comprising a microphone arrangement for capturing audio signals from ambient sound, an audio signal processing unit for processing the captured audio signals, and a transducer for providing the processed audio signals.

4. The hearing device of claim 3, wherein the hearing device is configured to be worn at ear level.

5. The hearing device of claim 4, wherein the hearing device is a hearing aid.

6. The hearing device of claim 5, wherein the sensor comprises at least one of an accelerometer, a temperature sensor, a humidity sensor, an acoustic feedback sensor, or an electromagnetic signal strength sensor.

7. The hearing device of claim 1, wherein the sensor comprises an accelerometer, and wherein the loss detection unit is configured to determine that the hearing device is no longer worn by the user if the sensed acceleration is below a given threshold value for at least a given time interval.

8. The hearing device of claim 1, wherein the sensor comprises a temperature sensor, and wherein the loss detection unit is configured to decide that the hearing device is no longer worn by the user if the sensed temperature is outside of a given temperature range including body temperature.

9. The hearing device of claim 1, wherein the sensor comprises a humidity sensor, and wherein the loss detection unit is configured to determine that the hearing device is no longer worn by the user if the sensed humidity is below a given threshold.

10. A method for detecting a personal device is lost, the method comprising:

analyzing, by the personal device, signals received from a sensor to determine whether the personal device is presently worn by a user;

operating the personal device in a regular mode when the personal device determines that the personal device is worn by the user;

operating the personal device in a loss mode when the personal device determines that the personal device is no longer worn by the user, wherein in the regular mode a wireless interface of the personal device transmits a non-traceable device address that is resolvable only to devices that have previously been authenticated with the personal device, and wherein in the loss mode the wireless interface transmits a traceable public device address that is traceable due to the propagation of public address information contained in the wireless frames of wireless communication protocol.

11. The method of claim 10, further comprising:

running, on an external device, an application program for detecting lost personal devices;

receiving, by the external device, the traceable public device address from the personal device; and directing, by the external device in response to the reception of the traceable public device address from the personal device, the external device and/or the personal device to generate an acoustic, visual, or tactile alert signal.

12. The method of claim 11, further comprising:

registering the personal device with a return service provider;

identifying, by the external device, the personal hearing device based on information transmitted together with the traceable public device address, determining whether the identified personal device is registered with the return service provider and, if so, notifying the return service provider that the personal device has been found; and initiating, by the return service provider, a transport process for returning the personal device to the user.

13. The method of claim 12, wherein the steps of registering the personal device with a return service provider; determining whether the identified personal device is registered with the return service provider and, if so, notifying the return service provider that the personal device has been found; and initiating a transport process for returning the personal device to the user utilize a public network.

14. A non-transitory computer-readable medium storing instructions that when executed by a processor cause a device to perform operations, the operations comprising:

determining when a device is worn by a user based on a sensor coupled to the personal device;

operating the personal device in a worn mode based on determining the device is worn, wherein the worn mode includes transmitting a device address that is readable only by devices that have previously paired with the device; and operating the personal device in a lost mode based on determining the device is not worn, wherein the lost mode includes transmitting a device address that is readable by all devices configured to receive wireless communications from the device.

15. The non-transitory computer-readable medium of claim 14, wherein the device is a hearing device.

16. The non-transitory computer-readable medium of claim 14, wherein the operations further comprise:

providing processed audio when the worn mode is operating.

17. The non-transitory computer-readable medium of claim 14, wherein the sensor is an accelerometer.

18. The non-transitory computer-readable medium of claim 14, wherein the sensor is an temperature sensor.

19. The non-transitory computer-readable medium of claim 14, wherein the sensor is a microphone, and the operations further comprises:

determining that the user of the device is speaking based on received signals from the microphone.

* * * * *